United States Patent [19]

Sando et al.

[11] Patent Number: 4,472,950

[45] Date of Patent: Sep. 25, 1984

[54] APPARATUS FOR WET HEAT TREATING A CLOTH CONTINUOUSLY

[75] Inventors: Yoshikazu Sando; Hiroshi Ishidoshiro, both of Wakayama, Japan

[73] Assignee: Sando Iron Works Co., Ltd., Japan

[21] Appl. No.: 463,645

[22] Filed: Feb. 3, 1983

[30] Foreign Application Priority Data

Feb. 12, 1982 [JP] Japan ..... 57-20759
Feb. 12, 1982 [JP] Japan ..... 57-20760

[51] Int. Cl.[3] ..... D06B 3/12; D06B 21/00

[52] U.S. Cl. ..... 68/5 E; 68/9; 68/181 R

[58] Field of Search ..... 68/5 E, 9, 181 R

[56] References Cited

FOREIGN PATENT DOCUMENTS 2030183 4/1980 United Kingdom ..... 68/5 E
2063943 6/1981 United Kingdom ..... 68/5 E
2063944 6/1981 United Kingdom ..... 68/5 E
2073266 10/1981 United Kingdom ..... 68/5 E

*Primary Examiner*—Philip R. Coe
*Attorney, Agent, or Firm*—McGlew and Tuttle

[57] ABSTRACT

An apparatus for wet heat treating a cloth continuously in a high pressure steamer provided with a plurality of guide rolls alternately disposed in upper and lower positions for transporting a cloth to be treated in a zig-zag path through the steamer body, comprising providing a liquid seal tank in an inlet side seal mechanism of the steamer body for applying a treating solution to the cloth initially and a plurality of treating solution applying tanks having different heights positioned below the liquid seal tank and immersing respectively one of the lower guide rolls therein for applying the treating solution to the cloth after the initial application, and repeatedly while the cloth is wet heat treated. The bottoms of the liquid seal tank and the treating solution applying tanks are connected to the lower tanks by means of liquid pipes, and a slow cooling tank is provided in an outlet side seal mechanism of the steamer body for cooling the cloth slowly with water. A plurality of prewashing tanks with the construction as in the treating solution applying tanks is provided for washing the cloth initially and repeatedly by utilizing the cooling water. The liquid tank in the inlet side seal mechanism of the steamer body may be substituted with a treating solution tank positioned out of the steamer body. Continuous wet heat treatment of a long cloth can be done uniformly and effectively.

9 Claims, 2 Drawing Figures

APPARATUS FOR WET HEAT TREATING A CLOTH CONTINUOUSLY

BACKGROUND OF THE INVENTION

The present invention relates to an apparatus for subjecting a long cloth to such a treatment as desizing, scouring, dyeing, milling and weight reduction continuously by wet heat treating the cloth in a high pressure steamer.

For subjecting a long cloth to such a treatment as desizing, scouring, dyeing, milling and weight reduction, there have been such processes, for instance, as the use of a perble range as disclosed by the present inventors and the use of a high pressure steamer as disclosed also by the present inventors. To describe the outline of the use of a perble range for the pretreatment of a cloth, the cloth to be treated is soaked with a caustic alkali solution, supplied in a reactor saturated with steam and steamed. In pretreating a cloth by using a high pressure steamer, for instance, the cloth to be treated is passed through a caustic solution stored in a liquid seal tank provided in the inlet side seal mechanism of a high pressure steamer, and the cloth is wet heat treated or steamed in the high pressure steamer body. In any of the two processes, the soaking of a cloth with a treating solution is done only one time prior to the wet heat treatment, so that the application of the treating solution is frequently insufficient according to the kind of cloth.

In soaking a cloth with a treating solution in a liquid tank provided outside of a high pressure steamer body, which is done also frequently in wet heat treating a cloth in a high pressure steamer, since the treating solution is at the normal temperature, the permeability of the treating solution to the cloth is inferior as compared with the case of a high temperature solution. The method of heating the treating solution outside of a steamer body consumes a large amount of heat energy uneconomically. It has been considered to supplement the application of a treating solution to the cloth in the steamer body by providing a liquid tank therein. By supplying a large amount of treating solution at normal temperature into the interior of the steamer body, however, the temperature of the steamer body is lowered and this causes steam to condense therein and the amount of treating solution in the treating tank is diminished to prevent the uniform wet heat treatment of the cloth.

Due to the increasing demand for high quality, mix-spinned, mix-knitted and mix-woven cloths of foreign fibers have been widely produced in recent years. In order to subject these cloths to the above-mentioned treatments and to obtain good results, a large amount of water and moisture must be applied to the cloth, and an excellent treatment can hardly be expected in a short period with these conventional methods.

Further, while the production of a very thick nylon cloth (for instance, Oxford) has been realized recently by weaving 100% nylon fibers with a denier of 210, in pretreating and dyeing such a very thick cloth by the conventional method of wet heat treatment, the cloth width becomes uneven due to the formation of wavy selvages, causing such problems in the subsequent treating steps that the transportation by nipping the selvages is difficult and dyeing speck occurs.

SUMMARY OF THE INVENTION

Under such circumstances, the object of the present invention is to offer a superior apparatus for treating a cloth by the wet heat treatment in a high pressure steamer.

The essential feature of the apparatus comprises a plurality of treating solution apply tanks having different heights in the steamer body for applying a treating solution to a cloth to be treated after an initial treatment and repeatedly while the cloth is transported in zigzag forming snaky undulations through a steamer body for the wet heat treatment of the cloth. The initial application of the treating solution to the cloth can be done either in a liquid seal tank provided in the inlet side seal mechanism of the steamer body or outside of the steamer body.

Since the treating solution is applied to the cloth repeatedly in the steamer body while the cloth is wet heat treated, the cloth is soaked with the treating solution uniformly and sufficiently, and the treatment, such as pretreatment and dyeing of a cloth, can be done uniformly and effectively.

DETAILED DESCRIPTION OF THE PREFERRED EMBODIMENTS

Preferred embodiments of the present invention will be described in detail in the following with references to the drawings showing the examples of the inventive apparatus.

EXAMPLE 1

Figure 1:
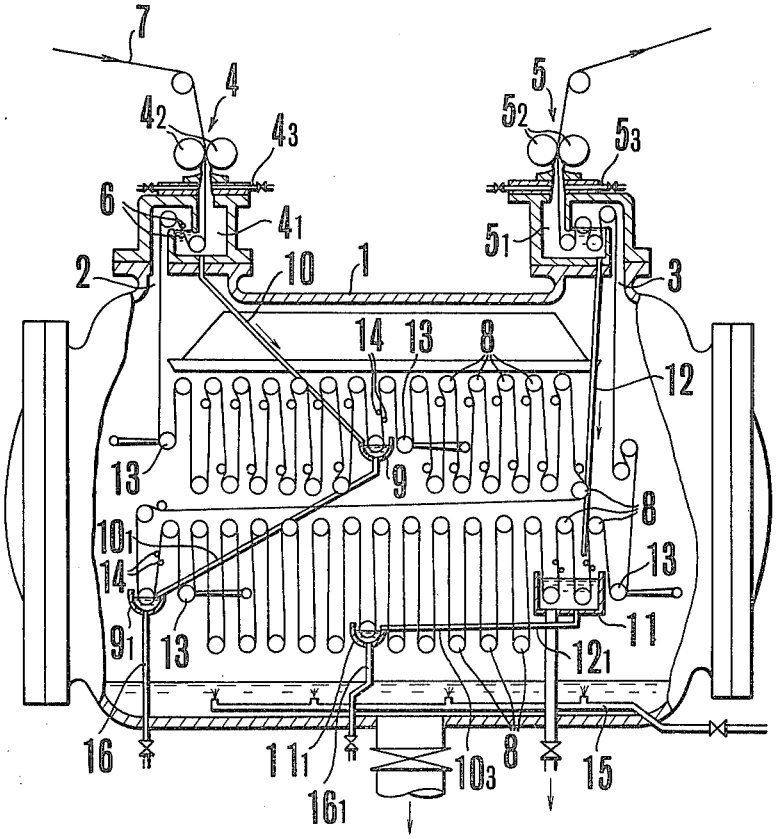
FIG. 1 is a sectional side view of an example of the present inventive apparatus for treating a cloth continuously in a high pressure steamer.

In FIG. 1, 1 is a high pressure steamer body for wet heat treating a long cloth continuously. The high pressure steamer body 1 is provided with a cloth inlet 2 and a cloth outlet 3 having respectively an inlet side seal mechanism 4 and an outlet side seal mechanism 5 for transporting a cloth to be treated 7 continuously through the steamer body 1 while maintaining the interior of the steamer body with a wet heat in the range, for instance, between 100° C. and 160° C. The inlet side seal mechanism 4 comprises a nearly J-shaped liquid seal tank $4_1$ having tolerably large height difference for soaking the cloth with a treating solution initially therein, a pair of seal rubber rolls $4_2$ for sealing the opening above the liquid seal tank $4_1$, and a treating solution supply pipe $4_3$ positioned above the liquid seal tank $4_1$. The outlet side seal mechanism 5 comprises nearly U-shaped slow cooling tank $5_1$ for introducing cooling water therein, a pair of seal rubber rolls $5_2$ and a cooling water supply pipe $5_3$. The positions of the seal rubber rolls $5_2$ and the cooling water supply pipe $5_3$ are the same as in the inlet side seal mechanism. The temperature of the slow cooling tank $5_1$ is controlled to about 50° C. at the exit. 6 are squeeze bars provided near the lower opening of the liquid seal tank $4_1$ for squeezing excess treating solution from the cloth 7 coming out of the liquid seal tank $4_1$.

8 are a plurality of guide rolls provided in upper and lower positions and in two series in the steamer body 1 for transporting the cloth 7 supplied in the steamer body in a zigzag fashion continuously through the steamer body 1. 9 and $9_1$ are treating solution apply tanks provided with a certain spacing and a height difference so as to immerse one of the lower side guide rolls 8 respectively therein for soaking the cloth repeatedly with the treating solution after the initial treatment in the steamer body 1. More than two treating solution apply tanks may be provide. 10 is a liquid pipe connecting the bottom of the liquid seal tank $4_1$ and the solution apply tank 9 for supplying a treating solution from the liquid seal tank $4_1$ into the solution apply tank 9 spontaneously by the height difference. $10_1$ is another liquid pipe for supplying the treating solution from the bottom of the solution apply tank 9 into the solution apply tank $9_1$. 11 and $11_1$ are prewashing tanks for prewashing the treated cloth 7 repeatedly by using the cooling water flowing down from the slow cooling tank $5_1$ in the steamer body 1. More than two prewashing tanks may also be provided. 12 is a liquid pipe for supplying cooling water in the slow cooling tank $5_1$ into the prewashing tank 11 spontaneously by the height difference. $12_1$ is another liquid pipe for supplying water from the prewashing tank 11 into the prewashing tank $11_1$. 13 are tension control rolls, 14 are squeeze bars, 15 is a steam pipe and 16 and $16_1$ are waste liquid pipes.

The construction of the apparatus in this example is as above described. Now, its function will be described.

In the first place, the interior of the steamer body 1 is maintained at a high temperature and high pressure wet heat by blowing super-heated steam through the steam pipe 15 into the steamer body 1. The liquid seal tank $4_1$ is filled with a treating solution (for instance, a hydrogen peroxide or caustic alkali solution in the case of pretreatment and a dye solution in the case of dyeing) through the treating solution supply pipe $4_3$, and the treating solution is supplied successively to the treating solution apply tanks 9 and $9_1$ by means of liquid pipes 10 and $10_1$. Similarly, cooling water is supplied successively to the slow cooling tank $5_1$, the prewashing tanks 11 and $11_1$ successively by means of the cooling water supply pipe $5_3$ and the liquid pipes 12 and $12_1$.

Then, a cloth to be treated 7 is supplied through the inlet side seal mechanism 4 into the steamer body 1 and transported continuously therethrough the zigzag path. The cloth is soaked initially with a treating solution in the liquid seal tank $4_1$ and wet heat treated in the steamer body 1 while receiving secondary soaking with the treating solution repeatedly. The treating solution is applied uniformly all over the cloth, and thus the treatment is done uniformly with no unevenness. Thus treated cloth 7 is washed repeatedly in the prewashing tanks $11_1$ and 11, and taken out of the steamer body 1 through the outlet side seal mechanism 5.

To illustrate the feature of this apparatus, the treating solution is applied to the cloth supplementarily and repeatedly in the course of wet heat treatment in the steamer body. The treating solution in the treating solution apply tanks 9 and $9_1$ and the washing water in the prewashing tanks 11 and $11_1$ have been heated at least up to 100° C. due to the atmosphere in the steamer body 1, so that the cloth is swollen up to the core part thereof sufficiently in immersing the cloth in these media, and the treatment and the prewashing of the cloth can be done quite uniformly and effectively. Further, since thet media in the solution apply tanks and the prewashing tanks have been heated sufficiently, the interior of the steamer body 1 can be maintained with a saturated wet heat without condensing water vapor.

The liquid seal tank $4_1$ is designed so as to store a definite amount of the treating solution constantly. Therefore, in passing a certain cloth through the liquid seal tank $4_1$ with a uniform speed, the concentration of the treating solution in the liquid seal tank is kept constant, and uniform treatment of the cloth can be done easily. Furthermore, since the treating solution flows down successively through the treating solution apply tanks 9, $9_1$ and so on, the treating solution becomes successively dilute, and the concentration of the treating agent in the waste solution exhausted through the waste liquid pipe 16 is sufficiently dilute, sparing the treating agent and solving the problem of public pollution.

Moreover, since the treating solution flows down from the bottom of liquid seal tank $4_1$ and the treating solution apply tank 9 to the lower tanks, floating matters such as waste pieces of yarns at the upper tanks do not enter into the lower tanks. Waste pieces of the yarns leaving from the cloth, which are liable to adhere to the surface of the guide rolls 8 can also be removed in passing through the treating solution apply tanks, so that the guide rolls are always cleaned and do not hinder the smooth transportation of the cloth.

EXAMPLE 2

Figure 2:
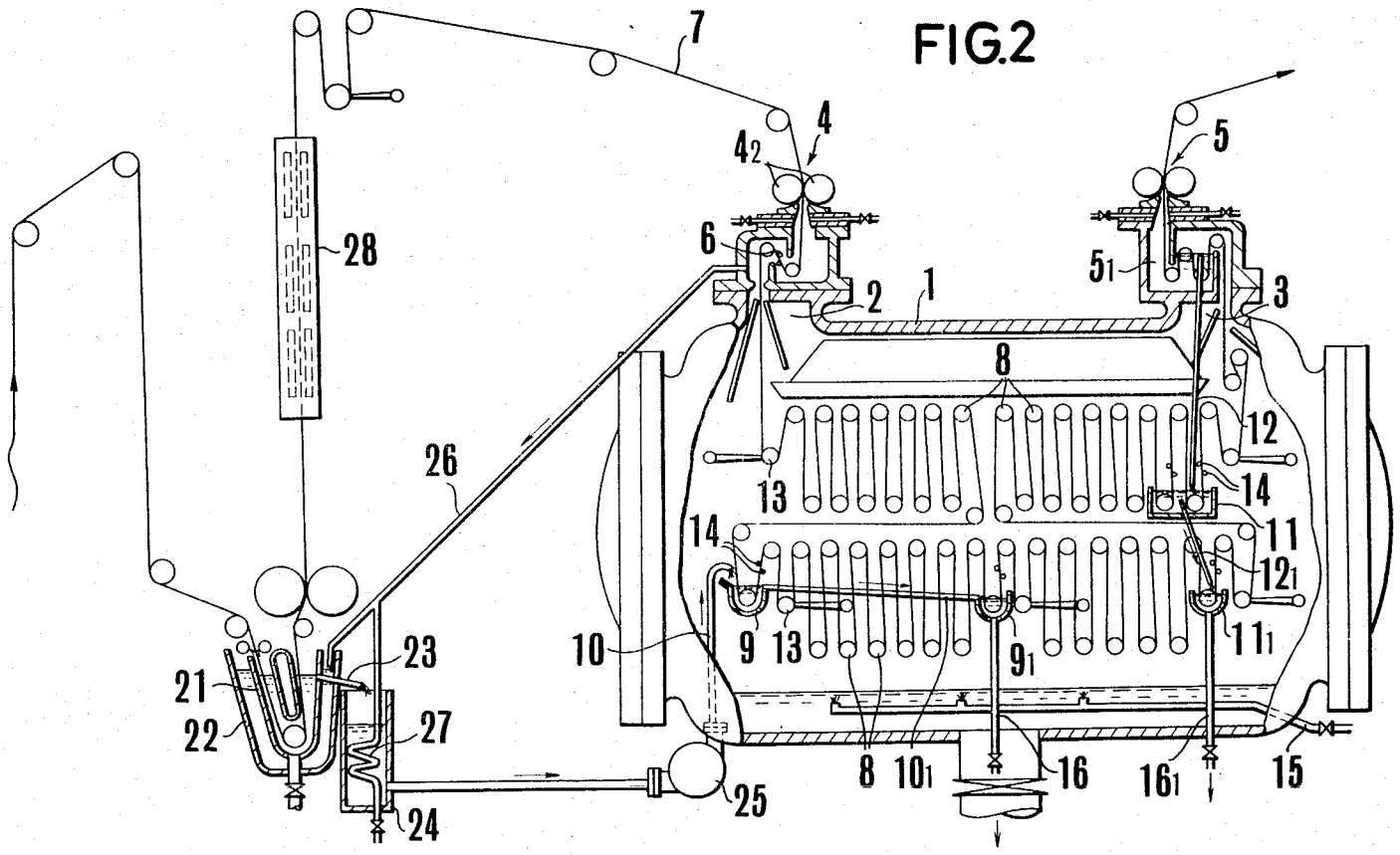
FIG. 2 is a sectional side view of another example of the present inventive apparatus.

Another example of the present inventive apparatus shown in FIG. 2 differs from the example in FIG. 1 in that the liquid seal tank $4_1$ for applying the treating solution initially to a cloth to be treated in Example 1 is substituted with a treating solution tank 21 outside of the steamer body 1.

In FIG. 2, 21 is a treating solution tank provided outside of the steamer body 1, and the treating solution tank 21 is surrounded by a hot liquid tank 22 forming a double layer structure. To the treating solution tank 21, a treating solution is supplied by a suitable means (not shown in the drawing) for soaking a cloth to be treated primarily with the treating solution. 23 is a liquid pipe for leading the treating solution overflowing from the treating solution tank 21 to a storage tank 24, and the treating solution in the storage tank 24 is supplied through the liquid pipe 10 into the treating solution apply tank 9 by means of a pump 25. 26 is a pipe for supplying hot water vapor in the inlet side seal mechanism 4 of the steamer body 1 into the hot liquid tank 22 for heating the treating solution tank 21 and the hot liquid tank 22. 27 is a hose branched from the liquid pipe 26 for heating the storage tank 24 to a high temperature. 28 is a drier for fixing the treating agent applied to the cloth in the treating solution tank 21 tentatively to the cloth. Other constructions of the apparatus in this Example are similar to those of the apparatus in Example 1.

Wet heat treatment of a cloth by using the apparatus in this Example is done, for instance, as follows.

A cloth to be treated 7 is supplied in the treating solution tank 21 provided outside of the steamer body 1 for soaking the cloth initially with a treating solution in the treating solution tank. Since the treating solution in this tank has been heated nearly to 100° C. with the use of waste vapor coming out of the steamer body, the soaking of the cloth with the treating solution can be done effectively in a short time.

The cloth soaked with the treating solution in the treating solution tank 21 is passed through the drier 28 (preferably an infrared drier) for removing water from the cloth, so that there is no danger that the treating agent (such as a caustic alkali or a dye solution) does not fall off in passing the cloth through the seal rubber rolls $4_2$ due to friction.

The manner of wet heat treatment of the cloth in the steamer body 1 is similar as in the preceding Example.

In this Example, the cloth is soaked with the treating solution initially outside of the steamer body, and secondarily and repeatedly in the course of wet heat treatment in the steamer body, so that continuous treatment of a cloth such as pretreatment and dyeing can be done uniformly and effectively. Since the supply of the treating solution is done outside of the steamer body, its concentration can be controlled easily. Further, the treating solution in the treating solution tank 21 and the storage tank 24 is heated with the use of the waste heat of the steamer body, so that necessary heat energy can be spared.

What we claim:

1. An apparatus for wet heat treating a cloth continuously in a high pressure steamer provided with a cloth inlet and a cloth outlet respectively having an inlet side seal mechanism and an outlet side seal mechanism and a plurality of guide rolls disposed alternately in upper and lower positions for transporting a cloth to be treated in a zigzag path through the steamer, comprising a liquid seal tank in the inlet side seal mechanism of the steamer for applying a treating solution to the cloth initially, and a plurality of treating solution apply tanks including at least one upper apply tank and one lower apply tank having different heights and positioned below the liquid seal tank for immersing respectively one of the lower position guide rolls therein so as to apply the treating solution to the cloth after the initial treatment and repeatedly while the cloth is wet heat treated, a bottom of the liquid seal tank being connected to the upper apply tanks and a bottom of the upper apply tank being connected to the lower apply tank by means of liquid pipes, and providing a slow cooling tank in the outlet side seal mechanism of the steamer for cooling the cloth slowly with water and a plurality of prewashing tanks including at least one upper and at least one lower prewashing tank having different heights below the slow cooling tank and immersing respectively one of the lower position guide rolls therein for washing the cloth initially and repeatedly by utilizing the cooling water, a bottom of the cooling tank being connected to the upper prewashing tank and a bottom of the upper prewashing tank being connected to the lower prewashing tank by means of liquid pipes.

2. An apparatus for wet heat treating a cloth continuously in a high pressure steamer provided with a cloth inlet and a cloth outlet respectively having an inlet side seal mechanism and an outlet side seal mechanism and a plurality of guide rolls disposed alternately in upper and lower positions for transporting a cloth to be treated in a zig-zag path through the steamer, comprising a treating solution tank spaced from the steamer for applying a treating solution to the cloth initially, means for heating the treating solution tank using waste vapor from the steamer, and a plurality of treating solution apply tanks including at least one upper apply tank and one lower apply tank having different heights and positioned below the inlet side seal mechanism for immersing respectively one of the lower position guide rollers therein so as to apply the treating solution to the cloth after the initial treatment and repeatedly while the cloth is wet heat treated, means for supplying the treating solution in the treating solution tank to the upper apply tank, a liquid pipe connecting the upper apply tank to the lower apply tank, a slow cooling tank in the outlet side seal mechanism of the steamer body for cooling the cloth slowly with water and a plurality of prewashing tanks including at least one upper and at least one lower prewashing tank having different heights positioned below the slowcooling tank and immersing respectively one of the lower position guide rolls therein for washing the cloth initially and repeatedly by utilizing the cooling water, a bottom of the slow-cooling tank being connected to the upper washing tank and a bottom of the upper washing tank being connected to the lower washing tank by means of liquid pipes.

3. An apparatus for wet heat treating a cloth continuously comprising:

a high pressure steamer body defining a steamer space;

an inlet side seal mechanism connected to said body for defining an inlet seal for cloth entering said steamer space;

an outlet side seal mechanism connected to said body and defining an outlet seal for cloth leaving said steamer space;

a plurality of upper guide rollers and a plurality of lower guide rollers alternating in a zig-zag fashion in said steamer space defining a zig-zag pathway for cloth in said steamer space;

a first treating solution tank associated with said steamer for initially treating cloth with a treating solution;

means for heating said first treating solution tank to elevate a temperature of treating solution in said first treating solution tank;

a plurality of second treating solution tanks disposed in said steamer space and including at least one upper solution tank and one lower solution tank, each of said upper and lower solution tanks positioned to receive one of said lower guide rolls to treat cloth with treating solution;

a first liquid pipe connected between said first treating solution tank and said upper solution tank for supplying treating solution to said upper solution tank;

a second liquid pipe connected between said upper solution tank and said lower solution tank for supplying treating solution to said lower solution tank, said lower solution tank being disposed downstream of said upper solution tank in said zig-zag path so that treating solution in said lower solution tank is diluted;

a first cooling water tank in said outlet side seal mechanism for slowly cooling cloth with water as the cloth leaves said steaming space;

a plurality of second cooling water tanks disposed in said steamer space including at least one upper cooling tank and one lower cooling tank;

a third liquid pipe connected between said first cooling tank and said upper cooling tank for supplying cooling water to said upper cooling tank; and a fourth liquid pipe connected between said upper cooling tank and said lower cooling tank for supplying cooling water to said lower cooling tank, said upper and lower cooling tanks being disposed between downstream of said upper and lower solution tanks in said zig-zag pathway and said lower cooling tank being disposed upstream of said upper cooling tank in said zig-zag path.

4. An apparatus according to claim 3, wherein said first treating solution tank is disposed in said inlet side seal mechanism, said means for heating the cooling solution comprising the proximity of said inlet side seal mechanism to said steamer body.

5. An apparatus according to claim 3, wherein said first treating solution tank is spaced from said steamer body, said means for heating treating solution in said first treating solution tank comprising a heating fluid pipe connected between said inlet side seal mechanism and said first treating solution tank.

6. An apparatus according to claim 5, wherein said first treating solution tank is lower than said upper solution tank and including pump means in said first liquid pipe for pumping solution from said first treating solution tank to said upper solution tank.

7. An apparatus according to claim 6, including a hot liquid tank engaged around said first treating solution tank and connected to said heating fluid line from said inlet side seal mechanism.

8. An apparatus according to claim 7, including a storage tank adjacent said hot liquid tank for receiving overflow from said first treating solution tank, said heating fluid line having a portion extending through said storage tank for heating contents of said storage tank, said first liquid pipe connected to said storage tank.

9. An apparatus according to claim 3, wherein said zig-zag path includes an upper portion having an upper plurality of upper and lower rollers and a lower portion including a second plurality of upper and lower rollers, at least one of said upper solution tank and said upper cooling tank being disposed in said upper portion of said zig-zag path and at least one of said lower solution tank and said lower cooling tank being positioned in said lower portion of said zig-zag path.

* * * * *